US010030353B2

(12) United States Patent
Dalena

(10) Patent No.: US 10,030,353 B2
(45) Date of Patent: Jul. 24, 2018

(54) COVER OF TRAPS OR MANHOLES EQUIPPED WITH A MECHANISM FOR LIFTING AND HORIZONTALLY TRANSLATING THE COVER

(71) Applicant: APULIA INNOVATIVE TECHNOLOGIES, S.R.L., Putgnano BA (IT)

(72) Inventor: Giambattista Dalena, Putignano (IT)

(73) Assignee: Apulia Innovative Technologies, S.R.L., Putignano BA (IT)

( * ) Notice: Subject to any disclaimer, the term of this patent is extended or adjusted under 35 U.S.C. 154(b) by 10 days.

(21) Appl. No.: 15/028,674

(22) PCT Filed: Oct. 6, 2014

(86) PCT No.: PCT/IT2014/000262
§ 371 (c)(1),
(2) Date: Apr. 11, 2016

(87) PCT Pub. No.: WO2015/052740
PCT Pub. Date: Apr. 16, 2015

(65) Prior Publication Data

US 2016/0258127 A1 Sep. 8, 2016

(30) Foreign Application Priority Data

Oct. 11, 2013 (IT) ..... BA2013A0067

(51) Int. Cl.
*E02D 29/14* (2006.01)
*B65D 90/62* (2006.01)
(Continued)

(52) U.S. Cl.
CPC ..... *E02D 29/1418* (2013.01); *B65D 43/20* (2013.01); *B65D 90/62* (2013.01);
(Continued)

(58) Field of Classification Search
CPC .... B65D 90/62; B65D 43/20; E02D 29/1445; E02D 29/1418; E03F 5/02
(Continued)

(56) References Cited

U.S. PATENT DOCUMENTS 3,475,860 A * 11/1969 Puczynski ..... E06B 3/4636 49/129
5,531,541 A * 7/1996 Clover ..... E02D 29/1418 220/816
(Continued)

FOREIGN PATENT DOCUMENTS

CH 661465 A5 * 7/1987 ..... B25B 27/14
DE 19514636 A1 10/1995
(Continued)

*Primary Examiner* — Katherine Mitchell
*Assistant Examiner* — Marcus Menezes
(74) *Attorney, Agent, or Firm* — Avery N. Goldstein; Blue Filament Law PLLC

(57) ABSTRACT

A cover (1) for manholes or traps is described, equipped with a mechanism for lifting and horizontally translating the cover (1), the mechanism being actuated through actuating means (10, 11, 12), and being adapted to automatically lift and afterwards horizontally translate or rotate the cover (1) to which it is operatively connected in order to completely open the manhole or trap.

3 Claims, 16 Drawing Sheets

(51) Int. Cl.
*B65D 43/20* (2006.01)
*E05F 15/60* (2015.01)
*E06B 3/52* (2006.01)

(52) U.S. Cl.
CPC ..... *E02D 29/1445* (2013.01); *E05F 15/60* (2015.01); *E06B 3/52* (2013.01); *E05Y 2400/30* (2013.01)

(58) Field of Classification Search
USPC ..... 49/131, 149, 209, 221; 404/25, 26
See application file for complete search history.

(56) References Cited

U.S. PATENT DOCUMENTS

| | | | | | |
|---|---|---|---|---|---|
| 5,732,512 | A * | 3/1998 | Ueno | E02D 29/14 | 404/25 |
| 7,341,398 | B2 * | 3/2008 | Johnson | E02D 29/1418 | 137/371 |
| 7,695,213 | B1 * | 4/2010 | Akkala | E02D 29/14 | 404/25 |
| 2007/0274779 | A1 * | 11/2007 | Johnson | E02D 29/1418 | 404/25 |
| 2008/0063471 | A1 * | 3/2008 | Veldboom | E02D 29/1427 | 404/25 |
| 2014/0000168 | A1 * | 1/2014 | Uehara | E06B 3/5054 | 49/149 |

FOREIGN PATENT DOCUMENTS

| | | | | |
|---|---|---|---|---|
| DE | 19642989 | A1 * | 4/1998 | B65F 1/1447 |
| EP | 1046754 | A1 * | 10/2000 | E02D 29/1418 |
| JP | 04261920 | A * | 9/1992 | |
| WO | WO 2010004183 | A1 * | 1/2010 | E02D 29/1418 |

* cited by examiner

A-A
1:1.5
B-B
1:1.5
1
2
3
4
4b
5
5e
5a
6
A
B

1
A
B
10'
1
C
10'
1
D
10'
1

1
3
4
4b'
4a'
5'
5a'
6
2

1
3"
2
5a"
5"
4a"
5b"
4"
6

COVER OF TRAPS OR MANHOLES EQUIPPED WITH A MECHANISM FOR LIFTING AND HORIZONTALLY TRANSLATING THE COVER

BACKGROUND OF THE INVENTION

1) Field of the Invention

The present invention relates to a cover of traps or manholes equipped with a mechanism for lifting and horizontally translating the cover.

In particular, the present invention deals with the field of covers of manholes or traps, also governed by UNI EN 124/1995 standard related to crowning and closing devices for circulating areas used by pedestrians and vehicles.

2) Background Art

Currently, the majority of such devices is of the cast iron type, whose movements are performed by means of manual lifting tools. Since such covers generally are more than 25 kg heavy, it is necessary to have two or more operators in order to perform such movements or to use a suitable working tool. Recently, covers have been devised which are hinged in one or more points: in this latter case, the cover is also made with many sections, and its handling is performed by rotating the cover upwards. Such arrangement provides for the sole use of cast iron covers. The type of filling covers, especially if having big sizes (greater than 70 cm by 70 cm), has the problems of having a great weight (more than 100 daN), of being generally custom built with a frame and hooks for performing cover movements, which can occur only through the use of suitable working tools (lifting trucks, mechanical blades, etc.). A variation in commerce consist in a filling cover hinged on one side, whose opening occurs with the help of some gas springs below the cover, whose function facilitating its lifting.

Summarizing, the trap covers ordinarily used have the following inconveniences:

1. They have reduced sizes linked to the need of reducing their weight
2. Are mainly made of a material (cast iron), different from the surrounding pavement
3. Have weight and shape not compatible with safety standards related to manual handling of loads (weight>25 daN with the risk of squashing lower limbs, in addition to the risk of fall of the cover into the trap, if it opening is not circular)
4. Big-sized covers cannot be manually handled
5. Their great weight has an incidence of transport costs.

SUMMARY OF THE INVENTION

Object of the present invention is solving the above prior-art problems, by providing a cover of traps or manholes equipped with a mechanism for lifting and horizontally translating the cover, which has the following features:

(1) Allows making bigger covers, which can be actuated by a single person (2) Allows using filling covers, with the chance of using the surrounding pavement (3) Lifting and moving the cover are performed without any operator effort (4) During the opening/closing step, the cover remain stably blocked by the mechanism guides, thereby preventing the chance of squashing the operator's limbs and the cover from falling inside the trap (5) Since the resisting part of the filling cover is made of laid conglomerate, the weight of the sold apparatus is reduced.

The above and other objects and advantages of the invention, as will appear from the following description, are obtained by a cover of traps or manholes equipped with a mechanism for lifting and horizontally translating the cover, as claimed in Claim 1. Preferred embodiments and non-trivial variations of the present invention are claimed in the dependent Claims.

It is intended that all enclosed claims are an integral part of the present disclosure.

BRIEF DESCRIPTION OF THE DRAWINGS

The present invention will be better described by some preferred embodiments thereof, given as a non-limiting example, with reference to the enclosed drawings, in which.

DETAILED DESCRIPTION OF PREFERRED EMBODIMENTS

Figure 1:
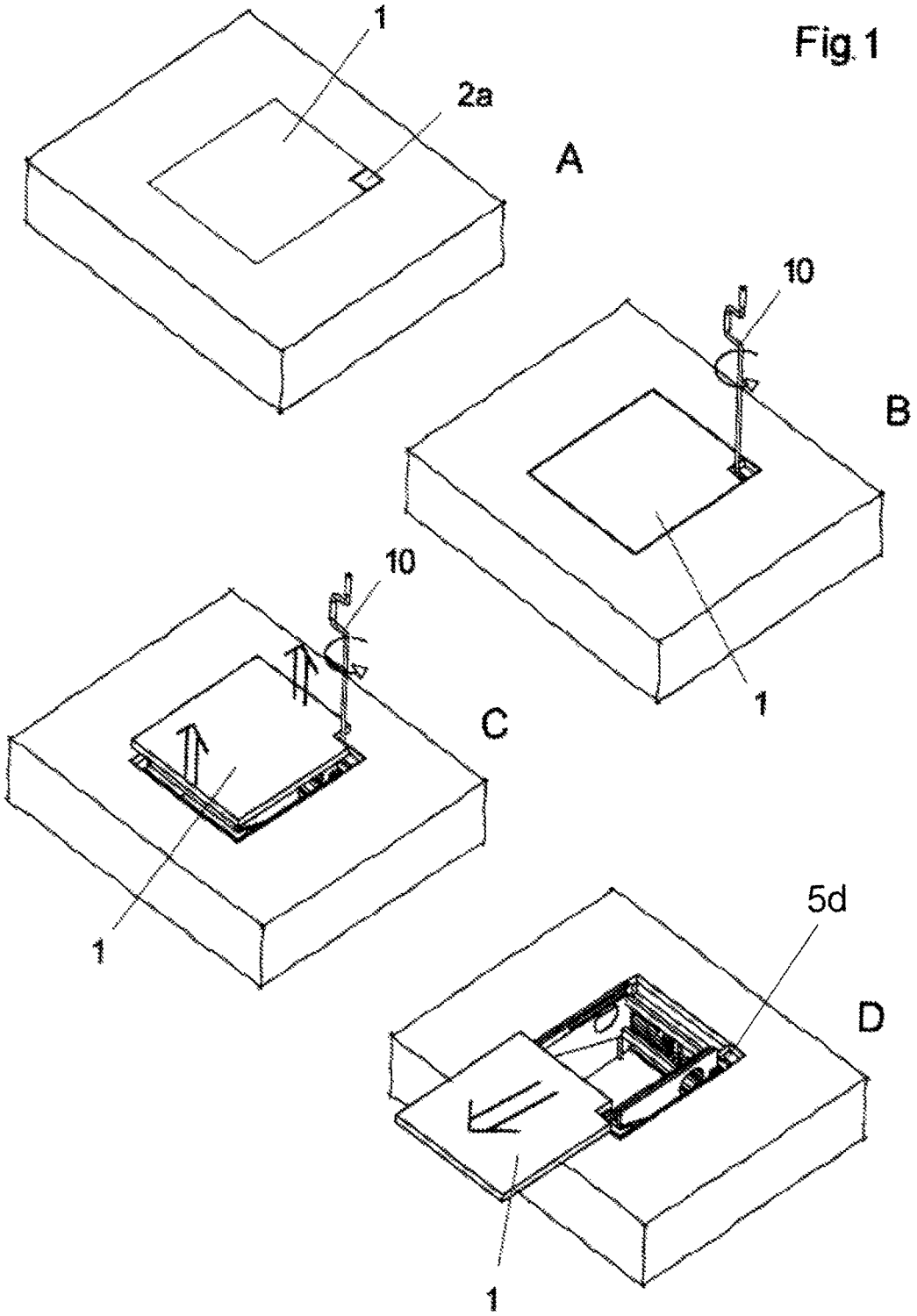
FIGS. 1 to 6 show a first preferred embodiment of the mechanism of the present invention.
Figure 2:
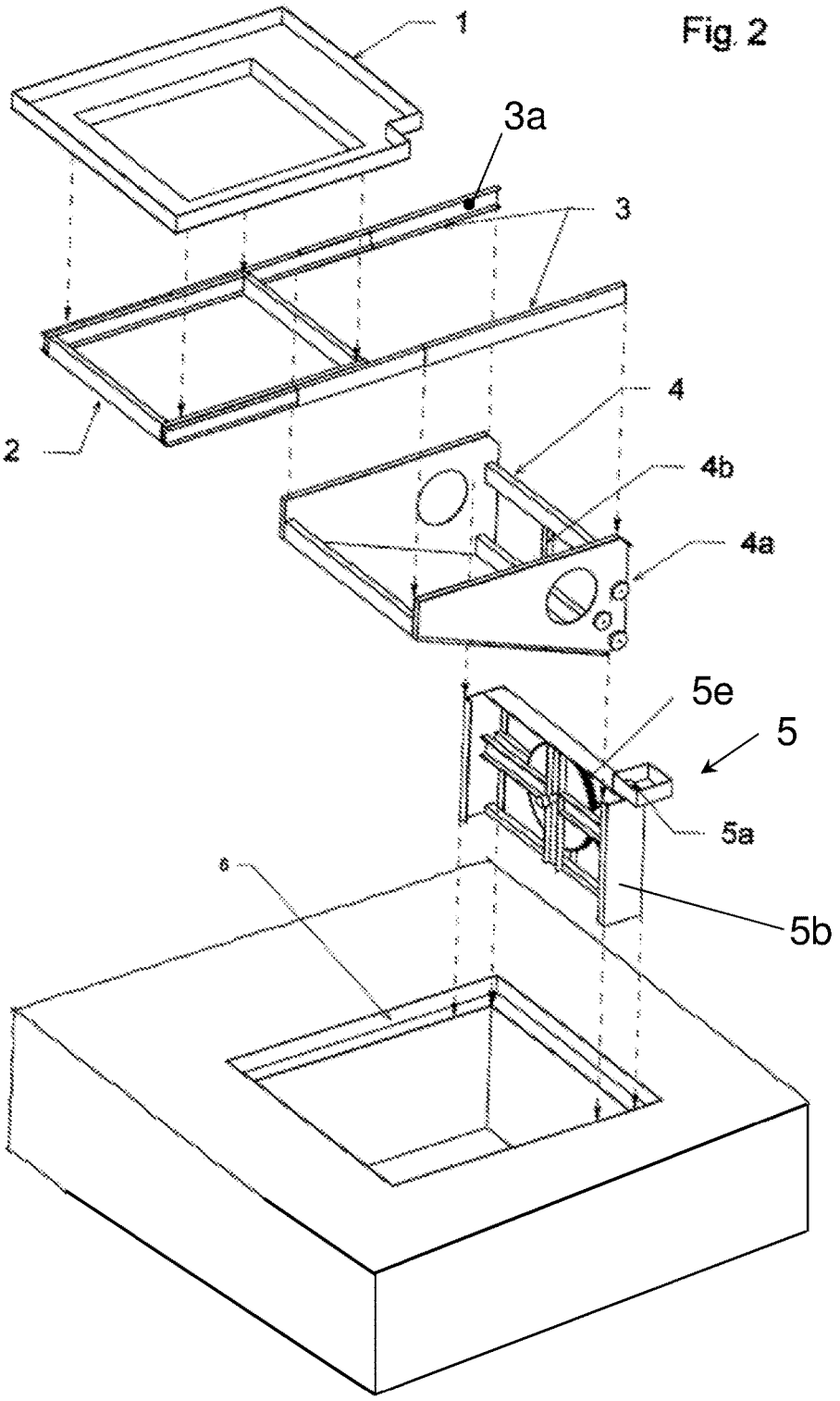
Figure 3:
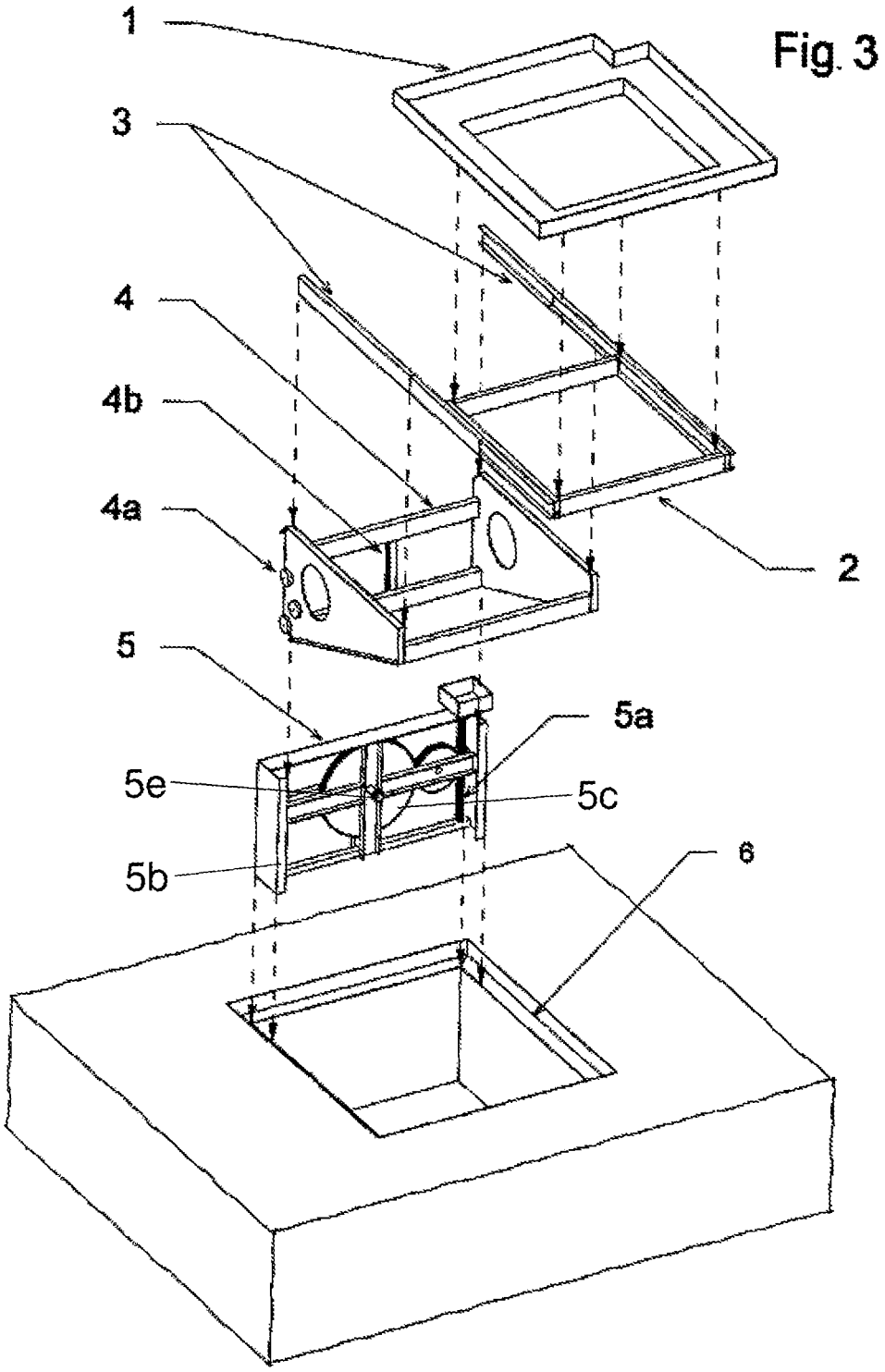

It will be immediately obvious that numerous variations and modifications (for example related to shape, sizes, arrangements and parts with equivalent functionality) could be made to what is described, without departing from the scope of the invention as appears from the enclosed claims.

The operation of the mechanism is shown in FIGS. 1, 4, 7 and 10: the cover in its rest position (A) is composed of two parts: the actual cover (1), mobile and coated with the same material of the surrounding pavement, and a small, fixed cover (2*a*), where the terminal part of the driving arrangement is housed: by means of a handle (10) (B), by acting on a worm screw, the mechanism is actuated and lifts the cover over the walking height (C). Now, telescopic guides allow the horizontal translation of the cover (D), leaving the trap hole adapted to be accessed. p According to a first preferred embodiment of the invention, shown in FIGS. 2 to 6, the mechanism is shown in its composing parts: it is composed of a filling cover (1) made of suitable material and sizes (plate made of zinc-coated steel, PVC, stainless steel, etc.) to contain the following conglomerate casting and the related metallic framework, to be performed in a yard. Under rest conditions, the cover abuts onto a fixed frame (6); when it is lifted, the mechanism engages the cover (1) which, due to its prismatic shape (FIG. 4), remains blocked in the mechanism whose movements it is constrained to follow. The cover-holding frame (2) in turn is fastened to two telescopic guides (3) having a complete extraction, fastened to a mobile lifting frame (4) which slides, through wheels (4*a*), onto a fixed guide (5*b*). The lifting movement occurs by means of a rack (4*b*) driven by a toothed wheel (5*c*) connected to a gear (5*e*) which originates in a driving trap (5*a*), which is for example a revolving type screw, which is driven by the external handle (10).

Summarizing, the mechanism is composed of a fixed part, (5)+(6), which is completely hidden, and of a mobile part, (2)+(3)+(4), which supports the actual cover. The small, fixed driving trap (5*a*) can be equipped with a lock, in its small cover (2*a*) or, through a suitable worked nut (driven by a special wrench), directly in the head 5*d* of the revolving screw.

Figures 4A, 4B, 4C:
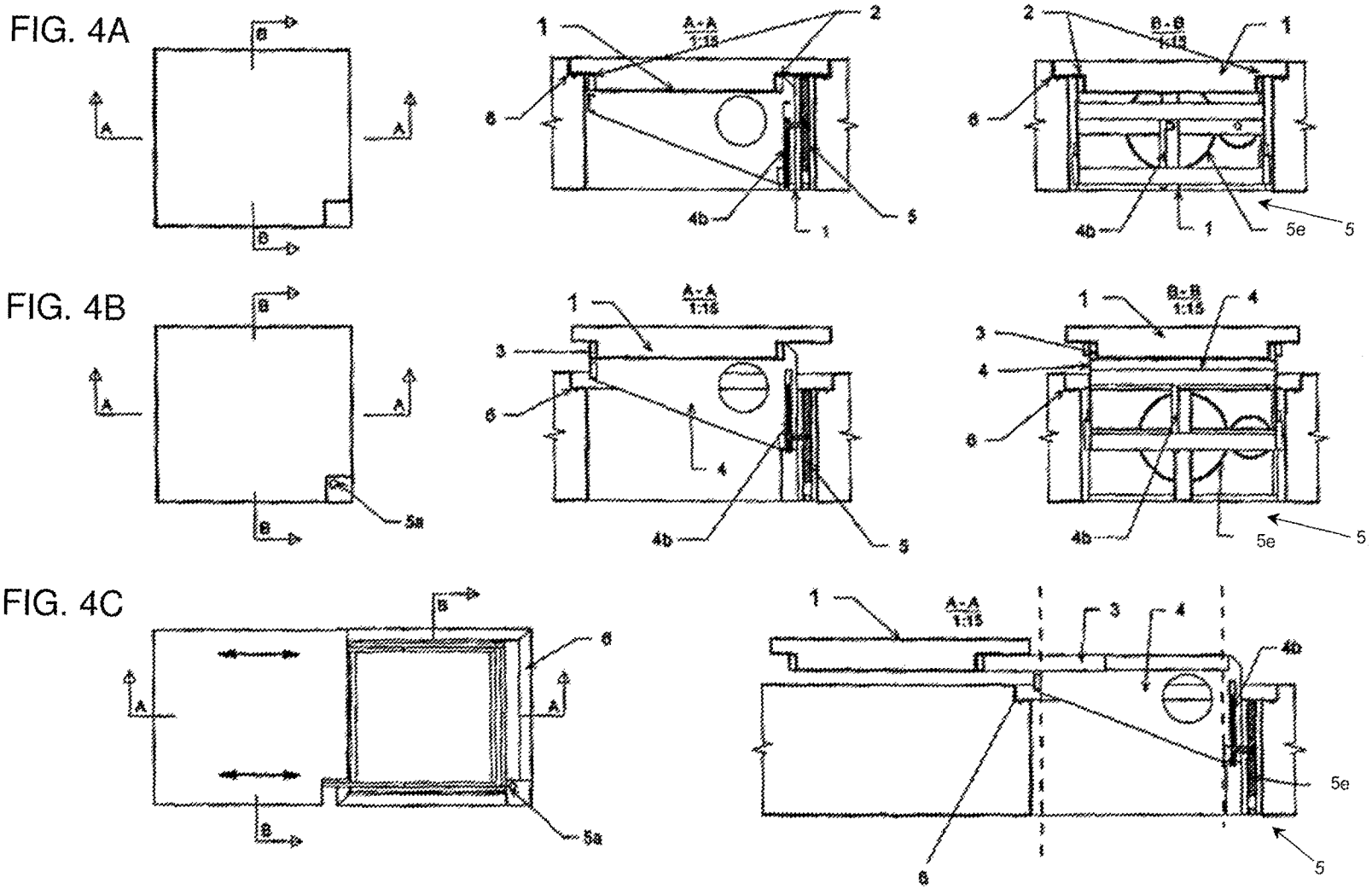

FIGS. 4A-C instead show, in the plan and sectional views, the mechanism in its three operating steps: closed (FIG. 4A), lifting (FIG. 4B) and translation (FIG. 4C).

Figure 5:
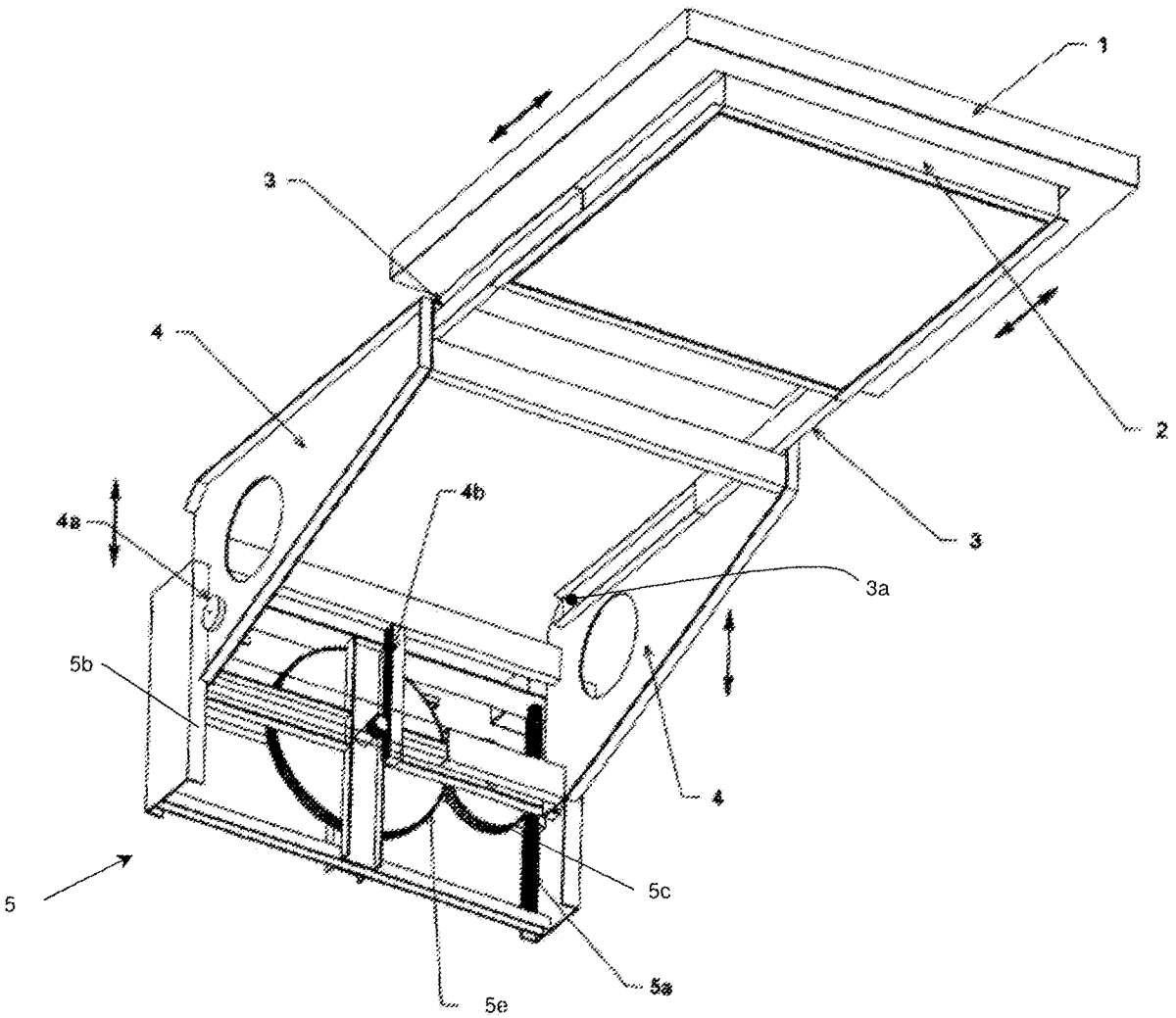

FIG. 5 is an axonometric bottom view pointing out the translating-elevating mechanism.

Figure 6:
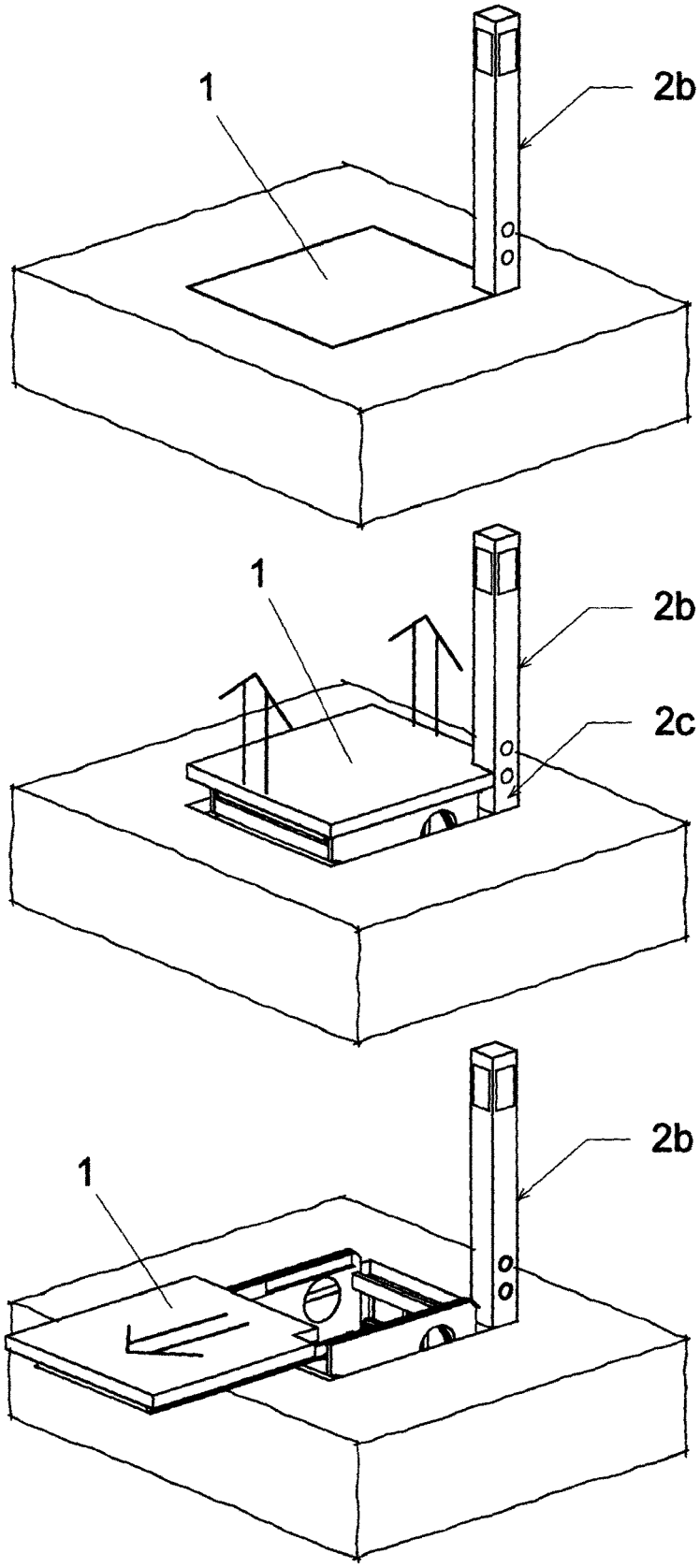
Figure 7:
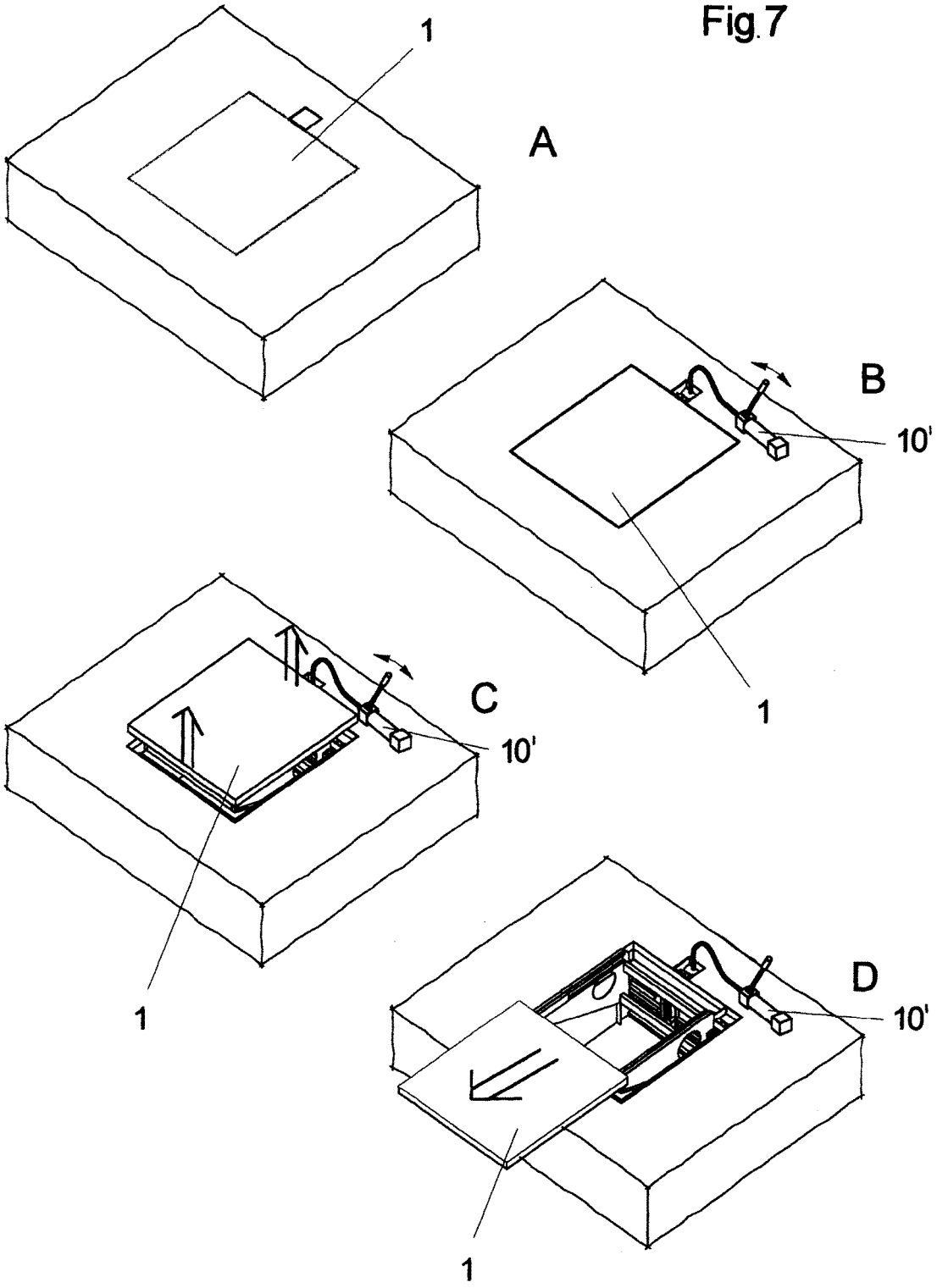
FIGS. 7 to 11 show a second preferred embodiment of the mechanism of the present invention.
Figure 8:
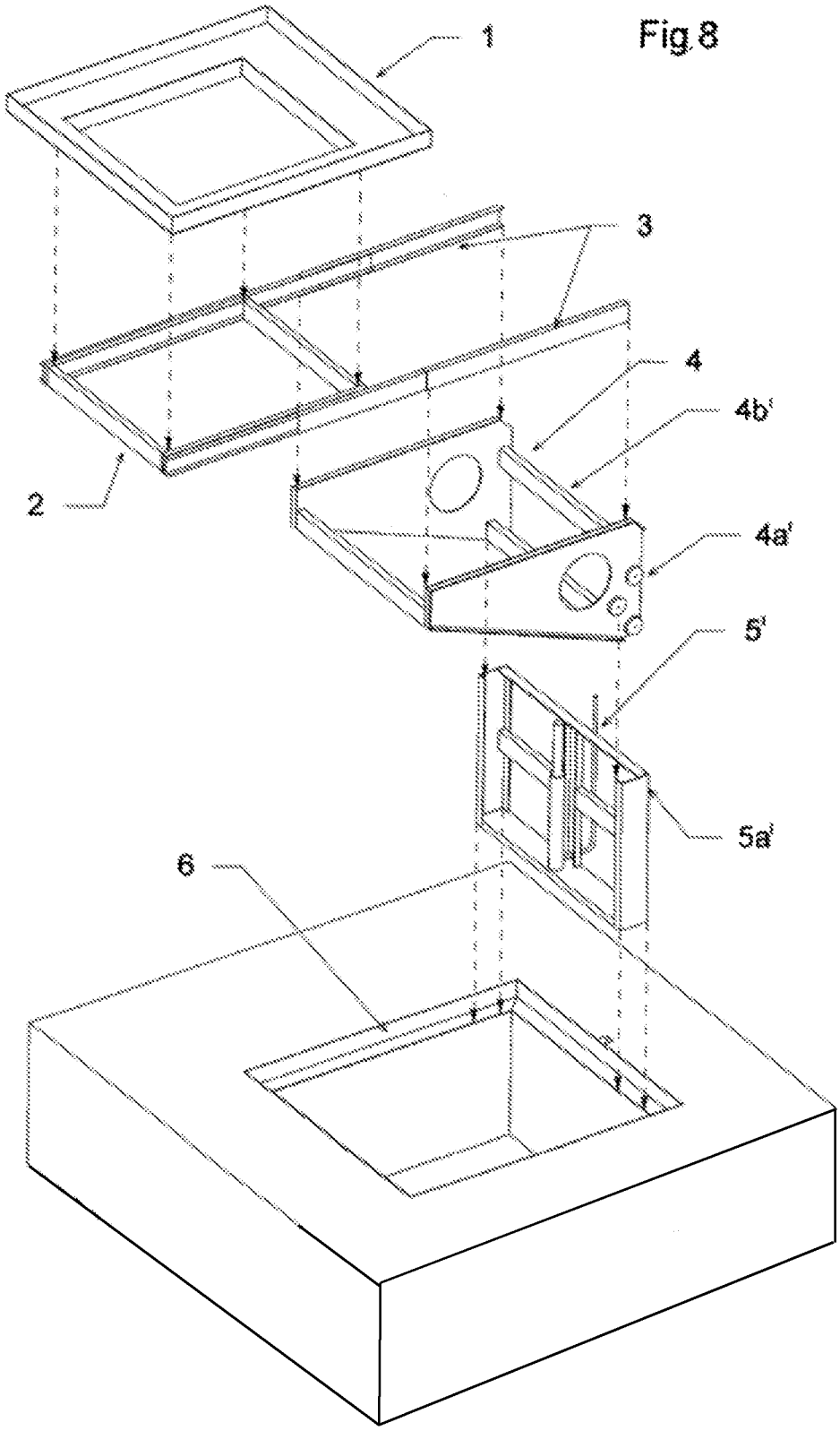
Figure 9:
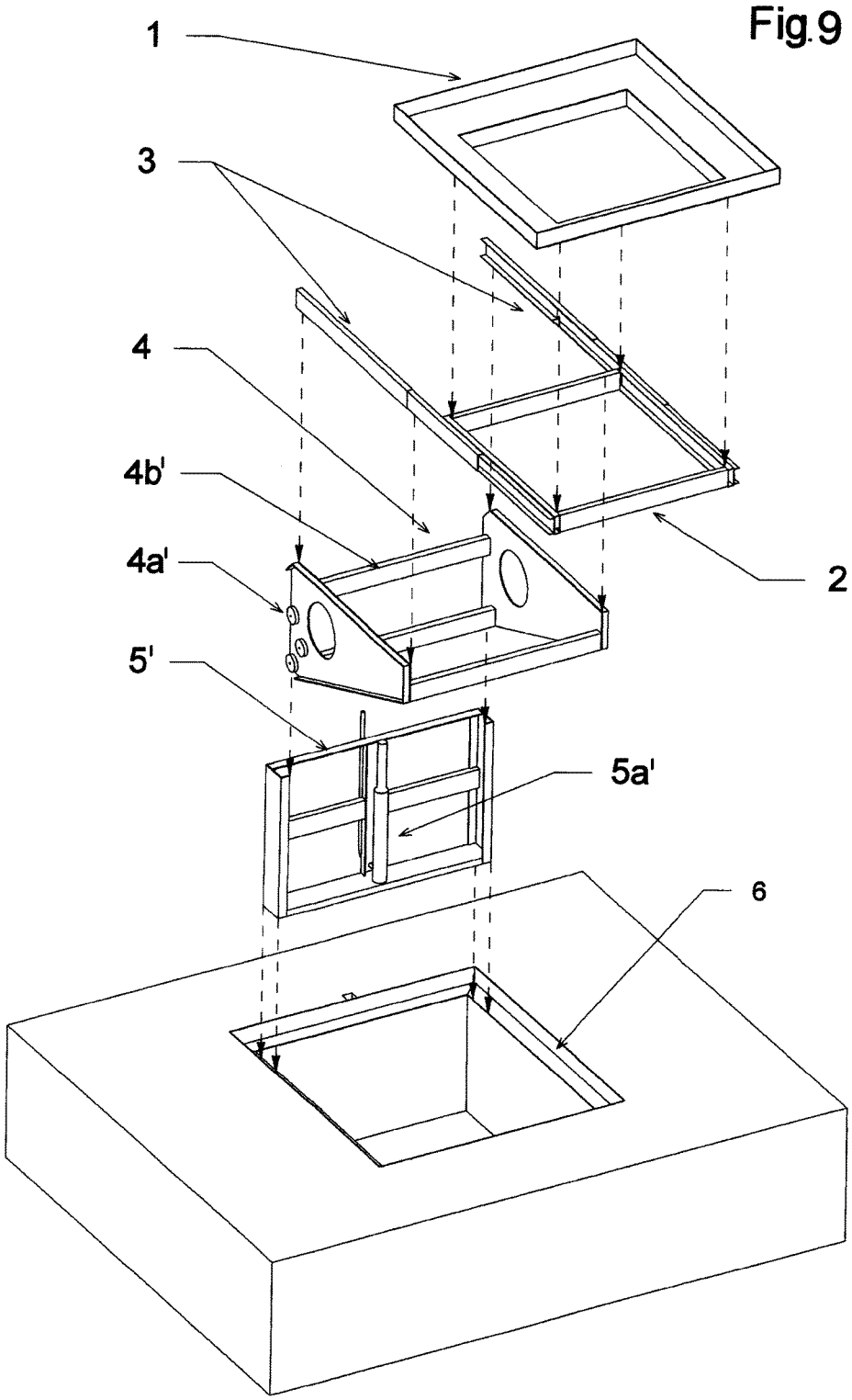
Figures 10A, 10B, 10C:
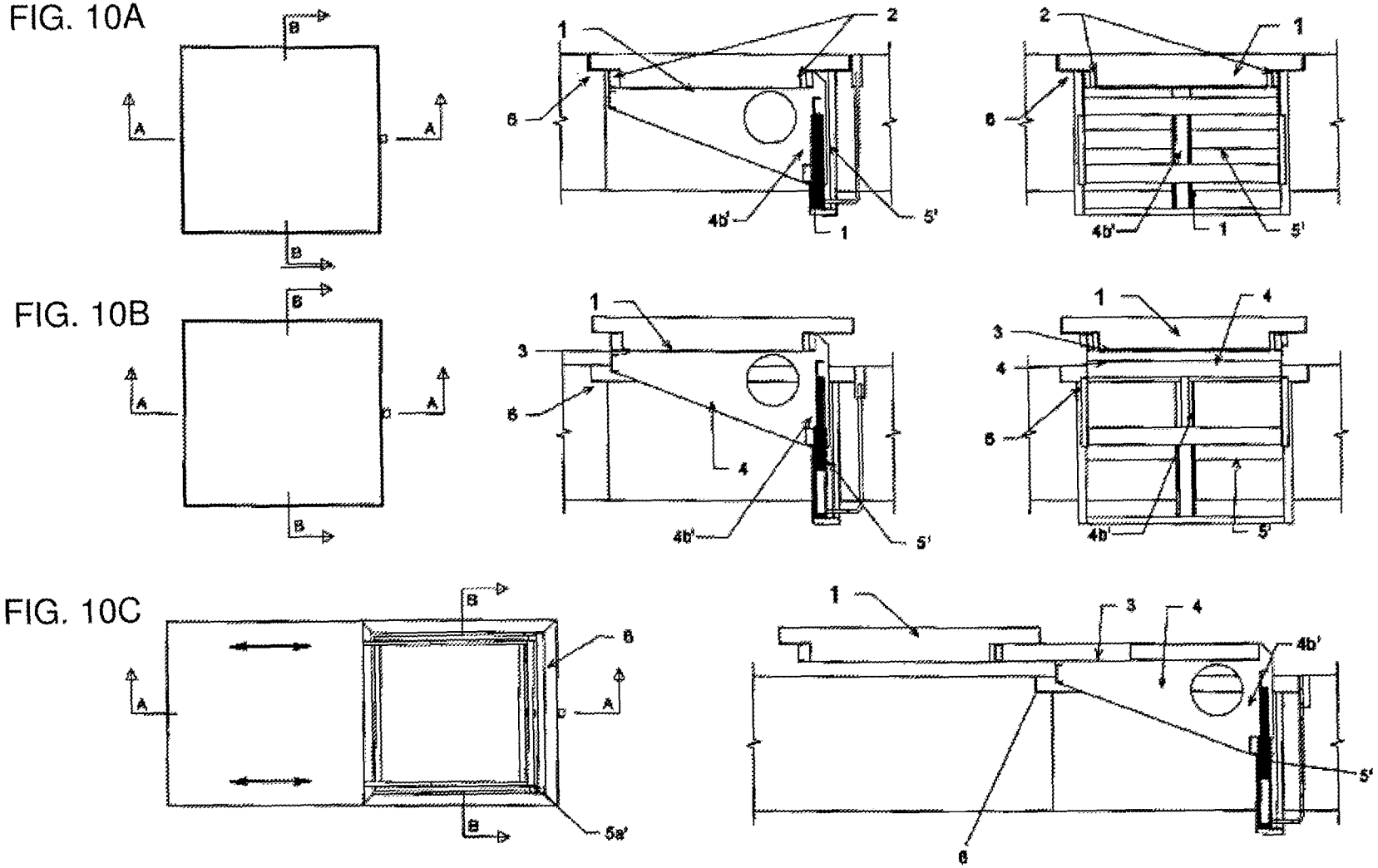
Figure 11:
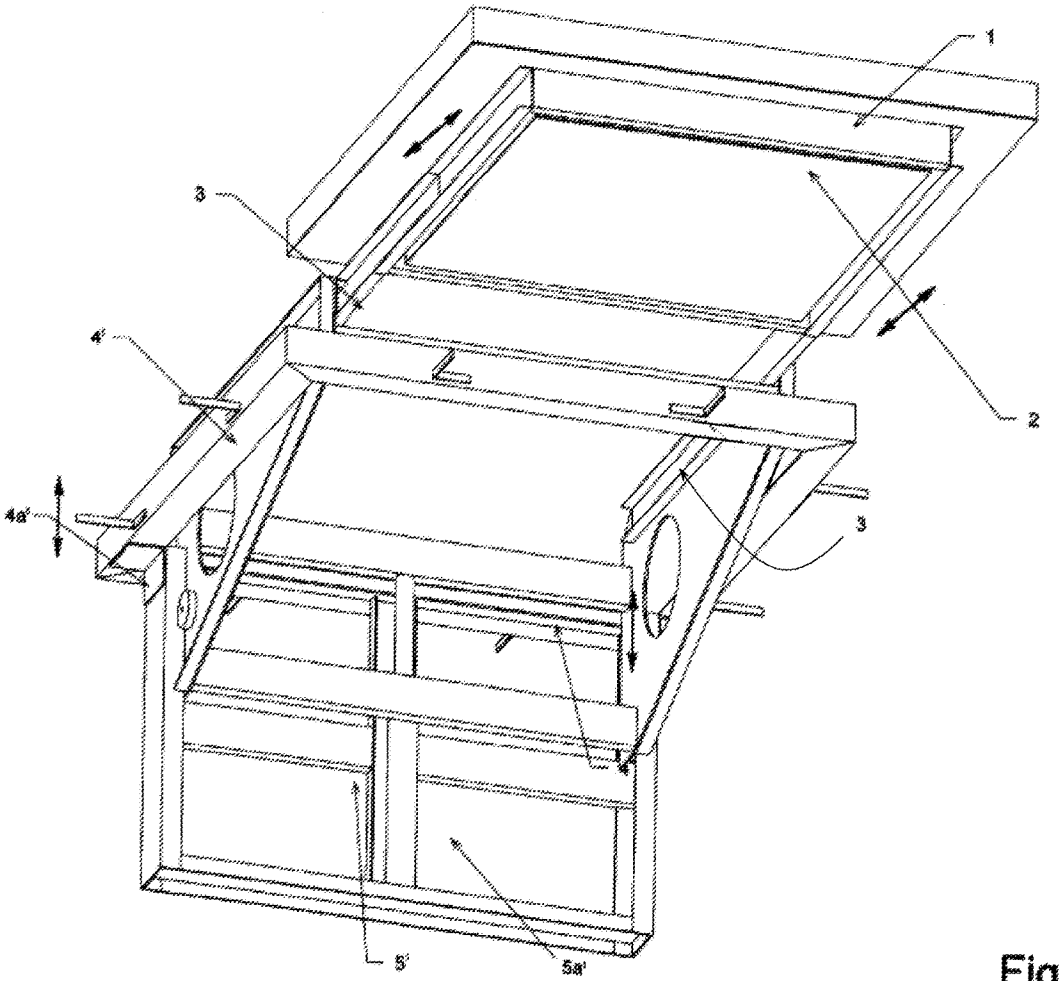

FIG. 6 shows a variation, always object of the present invention, where, in place of the small driving trap (5*a*), there is a prismatic turret (2*b*), adapted to contain therein an electro-mechanical motor (2*c*) for controlling the mechanism, namely to work as external terminal of mains services possibly running below the trap: electric energy, water, gas, compressed air, light, etc.

Preferably, the telescopic guides (3) are equipped with an opening and closing stopper 3*a*.

According to a second preferred embodiment of the invention, shown in FIGS. 7 to 11, the cover (1) is equipped with a mechanism composed of a frame (2) for supporting the mobile cover (1) fastened onto telescopic guides (3) having a complete extraction, in turn fastened to a mobile lifting frame (4), equipped with wheels (4*a*'), connected through a cross member (4*b*') to an hydraulic jack (5*a*') placed inside a fixed frame (5') whose actuation, by means of an external hydraulic pump (10'), lifts the mobile cover (1).

Figure 12:
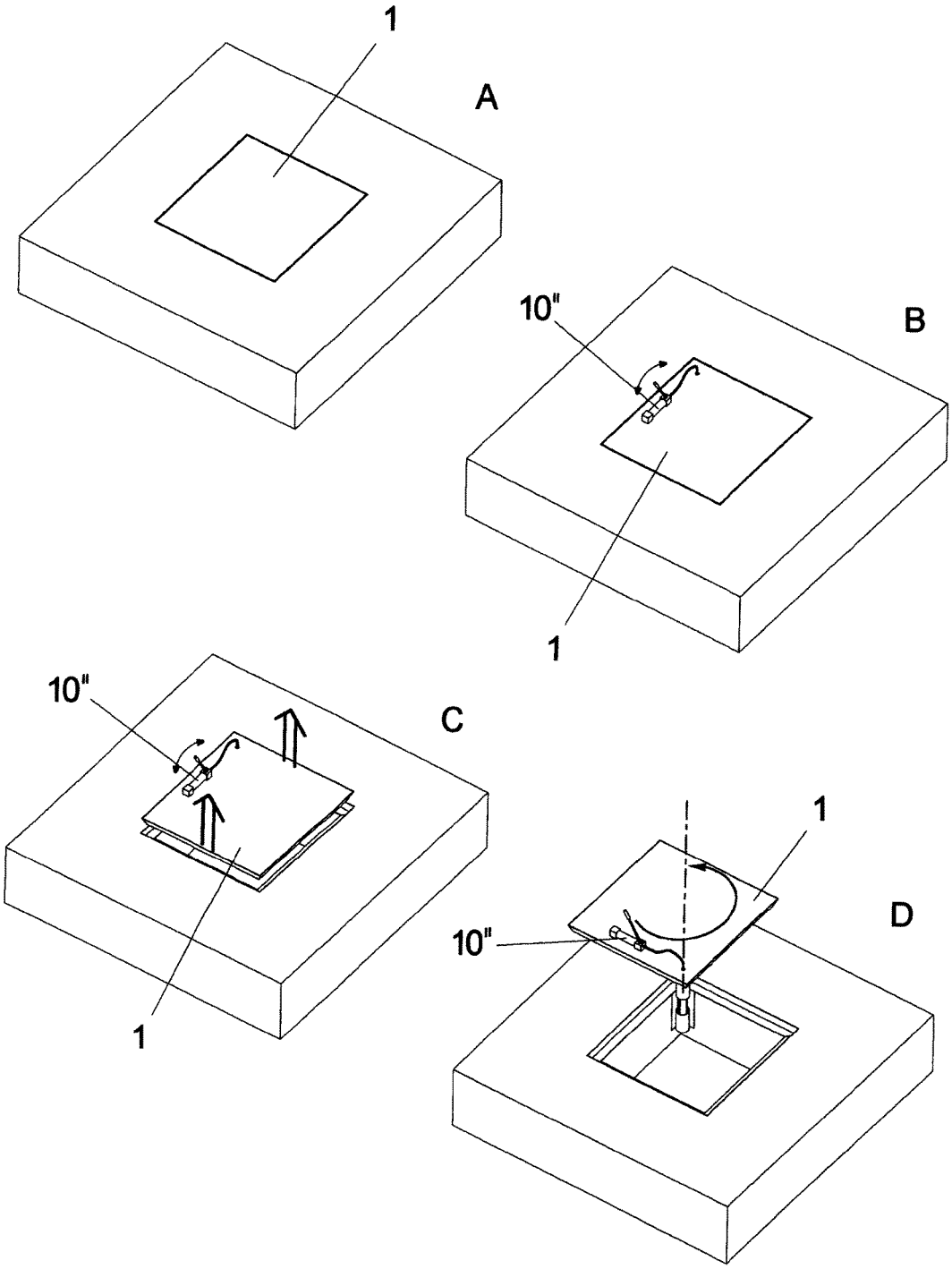
FIGS. 12 and 13 show a third preferred embodiment of the mechanism of the present invention.
Figure 13:
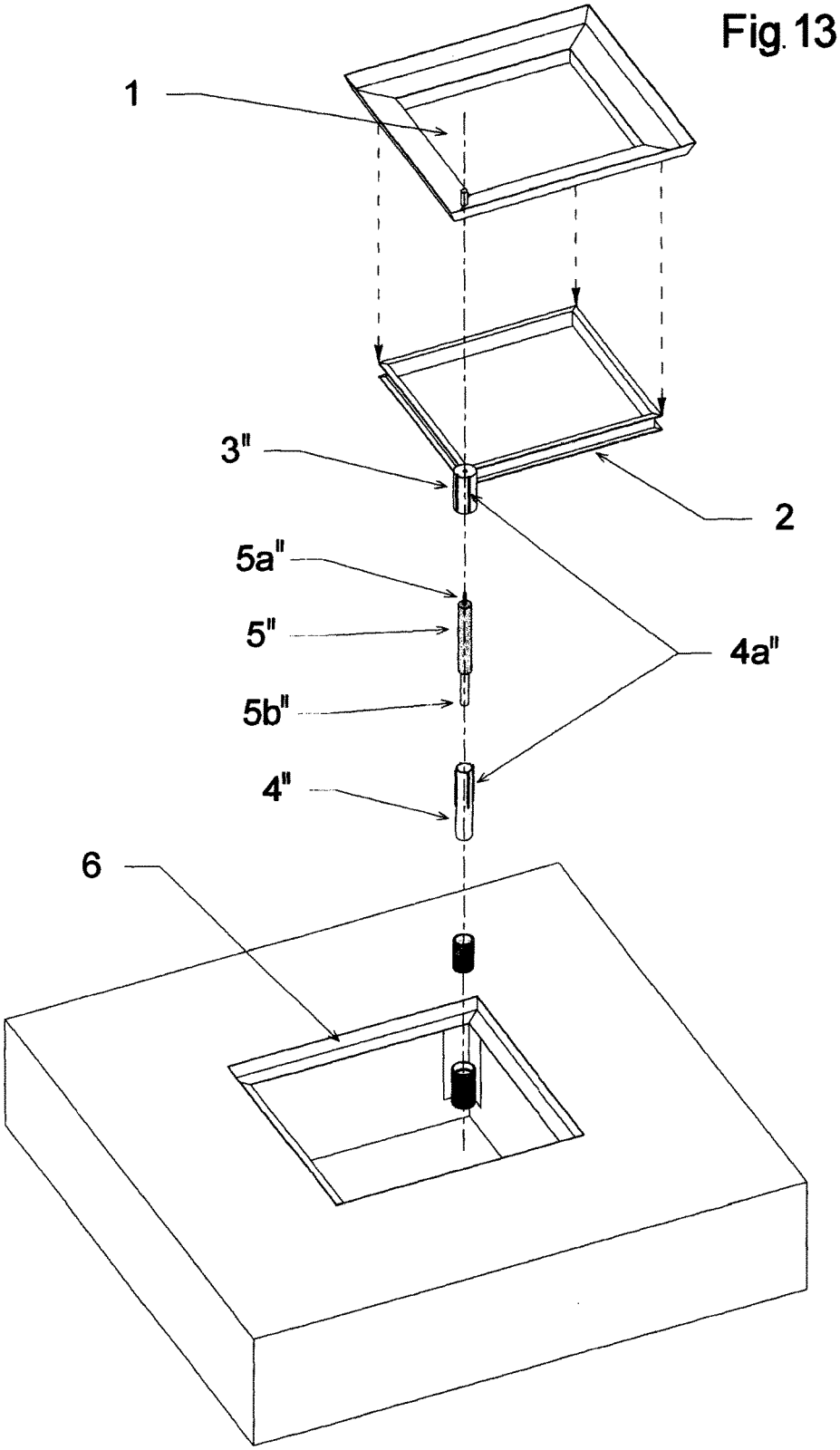

According to a third preferred embodiment of the invention, shown in FIGS. 12 and 13, the cover is equipped with a mechanism composed of a frame (2) for supporting the mobile cover (1) fastened to a ring (3") capable of performing a complete rotation around a vertical axis, in turn fastened to a mobile lifting concentric ring (4"), equipped with sliding trolleys (4*a*"), containing an hydraulic piston (5") having its cylinder oriented towards the cover (5*a*") and its piston oriented towards the support integral with the fixed frame (5*b*"), whose actuation, by means of an external hydraulic pump (10"), lifts the mobile cover (1).

Figure 14:
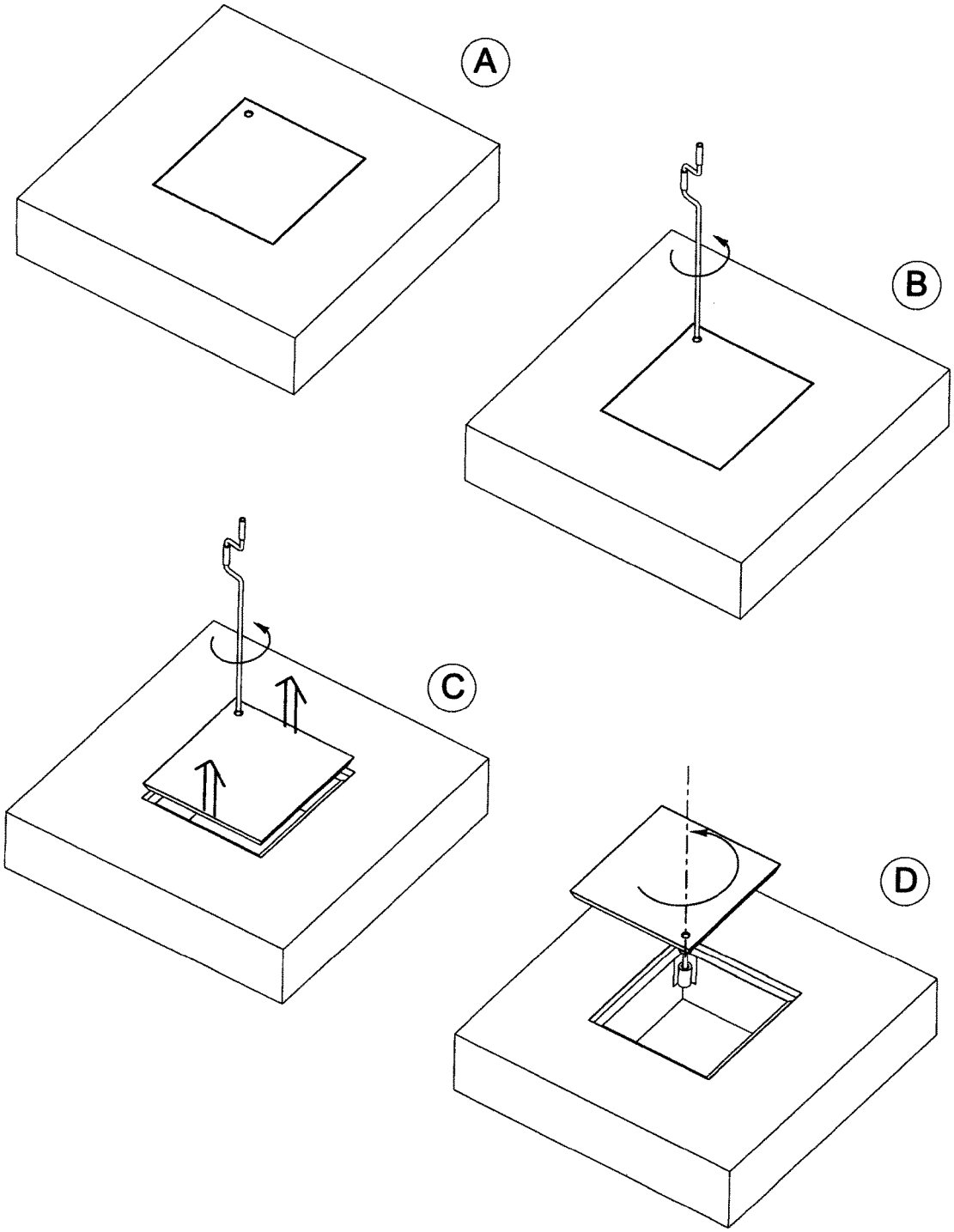
FIGS. 14 to 16B show a fourth preferred embodiment of the mechanism of the present invention.
Figure 15:
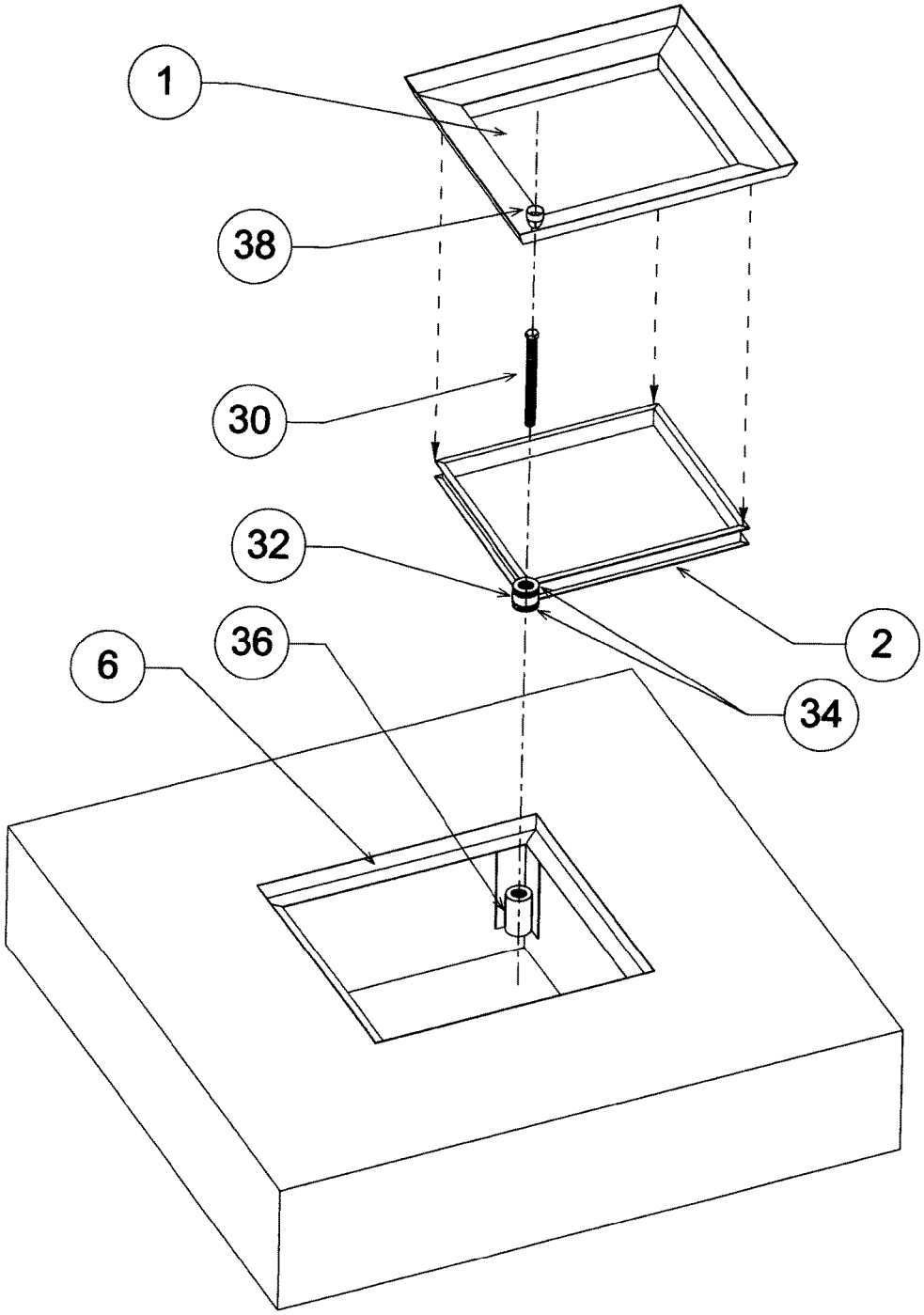
Figure 16A:
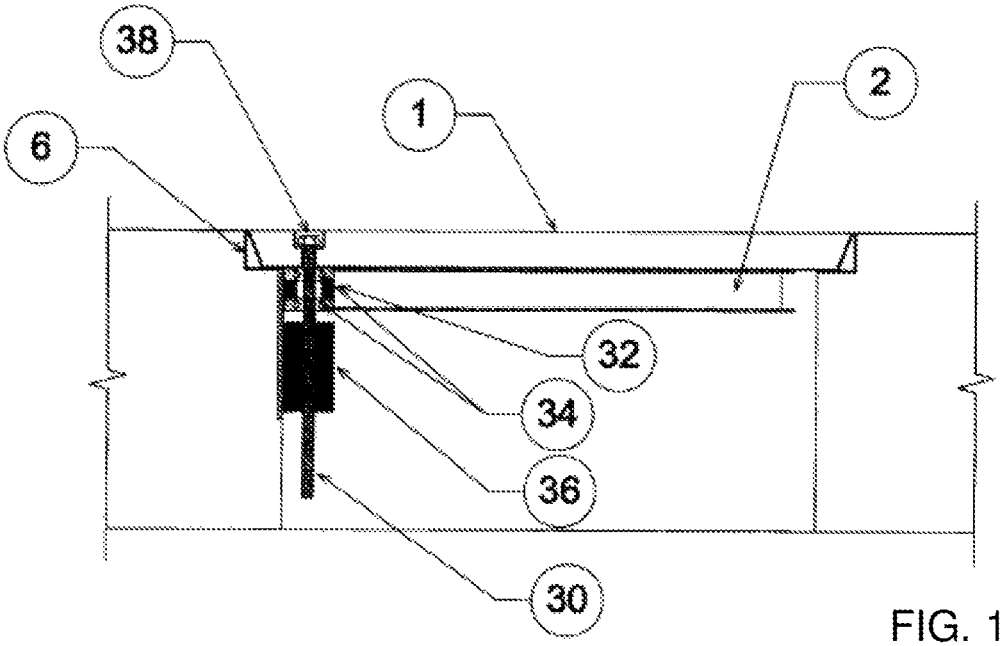
Figure 16B:
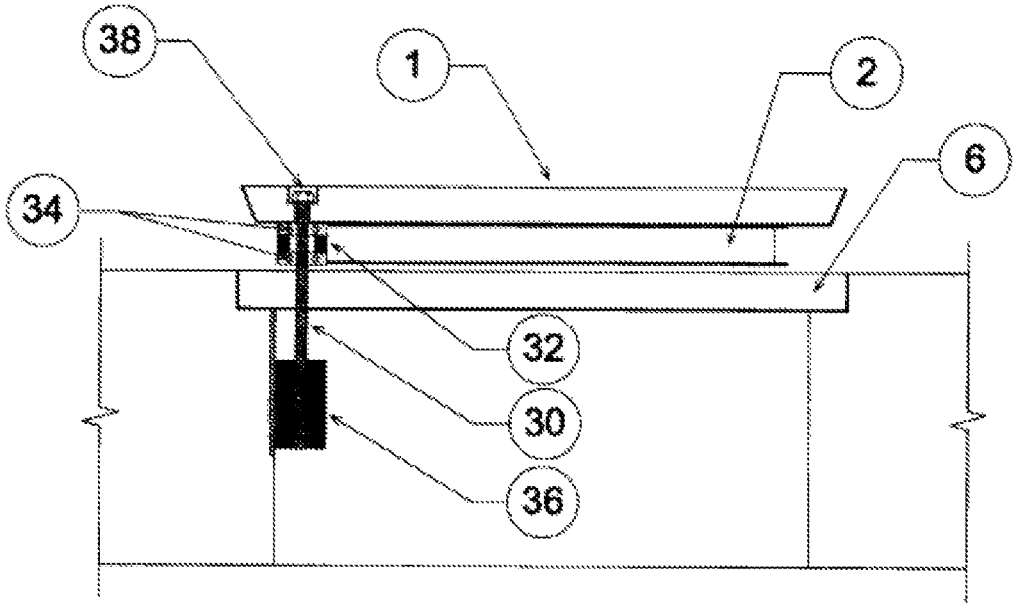

According to a fourth, preferred embodiment of the invention, shown in FIGS. 14 to 16, the frame (2) for supporting the mobile cover (1) is fastened to a ring (32) capable of performing a complete rotation around the vertical axis, and integral, by means of a pair of ball bearings (34) with axial resistance, with a screw (30), whose rotation, controlled by an external handle, inside a threaded sleeve (36) integral with the fixed frame (6), lifts the mobile cover (1) and, when closing, through the recess (38), pressure-closes the cover (1) onto the frame (6).

I claim:

1. A mechanism for lifting and moving a cover for a manhole or trap, wherein the manhole or trap is equipped with a mechanism for lifting and moving the cover in order to completely open the manhole or trap, wherein the mechanism is composed of a mobile frame for supporting the cover, the mobile frame fastened onto telescopic guides having a retracted position and an extended position, the telescopic guides are fastened to a mobile lifting frame equipped with wheels and a rack, the mobile lifting frame connected through the rack to a gear with toothed wheels of a fixed part, the gear with toothed wheels driven by a driving screw, and wherein actuation of the driving screw by a handle that is inserted into the driving screw causes the cover to lift.

2. The cover of claim 1, wherein the telescopic guides are equipped with an opening and closing stopper.

3. The cover of claim 1, wherein the telescopic guides are equipped with an opening and closing stopper.

* * * * *